US007046077B2

(12) United States Patent
Ozasa et al.

(10) Patent No.: US 7,046,077 B2
(45) Date of Patent: May 16, 2006

(54) CURRENT SOURCE CIRCUIT AND AMPLIFIER USING THE SAME

(75) Inventors: Masayuki Ozasa, Kyoto (JP); Hiroyasu Shimaoka, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/054,796

(22) Filed: Feb. 10, 2005

(65) Prior Publication Data

US 2005/0134366 A1 Jun. 23, 2005

Related U.S. Application Data

(62) Division of application No. 10/730,839, filed on Dec. 8, 2003.

(30) Foreign Application Priority Data

Feb. 14, 2003 (JP) ..... 2003-036431

(51) Int. Cl.
*G05F 1/10* (2006.01)
*G05F 3/02* (2006.01)

(52) U.S. Cl. ..... 327/541; 327/543

(58) Field of Classification Search ..... 327/538, 327/540–541, 543

See application file for complete search history.

(56) References Cited

U.S. PATENT DOCUMENTS 5,087,891 A * 2/1992 Cytera ..... 330/288
5,672,993 A * 9/1997 Runaldue ..... 327/404
5,818,295 A * 10/1998 Chimura et al. ..... 327/561
5,949,278 A * 9/1999 Oguey ..... 327/543
6,031,414 A * 2/2000 Kitamura ..... 327/538
6,353,344 B1 * 3/2002 Lafort ..... 327/108
6,411,159 B1 * 6/2002 Callahan, Jr. ..... 327/563

FOREIGN PATENT DOCUMENTS

JP 2-124609 5/1990

OTHER PUBLICATIONS

"Semiconductor Circuit Design Technology", Nikkei Business Publishers Inc., edited by T. Tamai, 1st edition, p. 302.
"CMOS Analog Circuit Design Second Edition", p. 196, published by OXFORD, Phillip E. Allen and Douglas R. Holberg.

* cited by examiner

*Primary Examiner*—Quan Tra
(74) *Attorney, Agent, or Firm*—Hamre, Schumann, Mueller & Larson, P.C.

(57) ABSTRACT

There is provided a current source circuit in which a outflow current of an output terminal is equal to an inflow current thereof. The current source circuit includes a first transistor group converting a reference current from a reference current source into a voltage and a first transistor having a current mirror relationship with the first transistor group, and allowing an output current to flow therethrough. An error amplifier compares a voltage generated in the first transistor group and supplied to one input terminal with a voltage supplied to the other input terminal. A second transistor is driven with an output voltage of the error amplifier. A third transistor is driven with the output voltage of the error amplifier, and allows an output current to flow therethrough in a direction opposite to the output current of the first transistor with respect to an output terminal. A second transistor group converts a current flowing through the second transistor into a voltage to supply the voltage to the other input terminal of the error amplifier.

1 Claim, 22 Drawing Sheets

CURRENT SOURCE CIRCUIT AND AMPLIFIER USING THE SAME

This application is a division of U.S. application Ser. No. 10/730,839 filed Dec. 8, 2003.

BACKGROUND OF THE INVENTION

1. Field of the Invention

The present invention relates to a current source circuit used in electronic equipment and a semiconductor integrated circuit, and an amplifier using the current source circuit.

2. Description of the Related Art

Conventionally, a current source circuit used in electronic equipment and a semiconductor integrated circuit is disclosed as a current mirror circuit, for example, in JP 2(1990)-124609 A, and Semiconductor Circuit Design Technology (Nikkei Business Publishers Inc., edited by T. Tamai, 1st edition, p. 302).

FIG. 20 is a circuit diagram showing an exemplary configuration of a conventional current source circuit. In FIG. 20, reference numeral 1 denotes a power supply terminal for supplying a voltage for operating a circuit, 2 denotes a reference current source for supplying a reference current, 4 denotes an output terminal through which a current flows out, 5 denotes an output terminal through which a current flows in, M2, M12, and M7 denote n-channel MOS transistors, and M6 and M20 denote p-channel MOS transistors. M2, M12, and M7 constitute a current mirror circuit, and M6 and M20 also constitute a current mirror circuit.

Next, the operation of the current source circuit thus configured will be described. The current that flows in from the reference current source 2 is received by the n-channel MOS transistor M2, and inverted by the n-channel MOS transistors M7 and M12, respectively. The current inverted by the n-channel MOS transistor M7 is drawn in through the output terminal 5. The current inverted by the n-channel MOS transistor M12 is received by the p-channel MOS transistor M20, and further inverted by the p-channel MOS transistor M6 to flow out through the output terminal 4.

FIG. 21 is a circuit diagram showing an exemplary configuration of a current source circuit configured in the same way as in FIG. 20, which includes the reference current source 2 through which a current flows out, the p-channel MOS transistors M2, M12, and M7, and the n-channel MOS transistors M6 and M20.

Furthermore, a common feedback circuit for setting an operation point of an amplifier using the current source circuit shown in FIG. 20 is disclosed, for example, in "CMOS Analog Circuit Design Second Edition" (p. 196, published by OXFORD, Phillip E. Allen, Douglas R. Holberg). FIG. 22 shows the configuration of this amplifier.

In FIG. 22, reference numeral 6 denotes a voltage source, 8 and 9 denote input terminals of the amplifier, 11 and 12 denote loads, 13 and 14 denote output terminals of the amplifier, M10, M11, M18, and M19 denote n-channel MOS transistors, and M6*a*, M6*b*, M8, and M9 denote p-channel MOS transistors.

Next, the operation of the amplifier thus configured will be described. Signals input from the input terminals 8 and 9 of the amplifier are converted into currents by the n-channel MOS transistors M18 and M19 constituting a differential amplifier, and formed into amplified voltages by the loads 11 and 12 to be taken out from the output terminals 13 and 14 of the amplifier. In order to determine an operation point of the amplifier, the voltage at a connection point between the loads 11 and 12 is compared with the voltage of the voltage source 6 by the n-channel MOS transistors M10 and M11 constituting the differential amplifier (error amplifier), whereby currents flowing through the current mirror circuits M8, M6*a*, and M6*b* are adjusted. As a result, the operation points of the loads 11 and 12 are set to be the voltage of the voltage source 6.

Conventionally, in the case where an inflow current and an outflow current are used simultaneously in a current source circuit of electronic equipment and a semiconductor integrated circuit and a current source circuit used in an amplifier, there is a problem that these currents are not equal to each other.

In MOS transistor properties, a current Ids is represented by the following expression:

$$Ids = k \times (Vgs - Vt)^2 \times (1 + \lambda \times Vds)$$

where Ids is a current of a MOS transistor, k is an amplification ratio, Vgs is a gate-source voltage, Vt is a threshold voltage, λ is a channel length modulation coefficient, and Vds is a drain-source voltage. A supplied current is influenced by a channel modulation effect every time it passes through a MOS transistor. Assuming that the sizes of the transistors are designed to be equal to each other, Vds is set to be substantially the same, and λ of the n-channel is substantially the same as that of the p-channel, a current ratio of an inflow current I5 flowing through the output terminal 5 to an outflow current I4 flowing through the output terminal 4 in FIG. 20 is approximated as follows:

$$\begin{aligned} I4/I5 &= (1 + \lambda \times Vds)^2 / (1 + \lambda \times Vds) \\ &= (1 + \lambda \times Vds) \end{aligned}$$

and the current ratio is not 1. For example, when λ=0.05 and Vds=1.5 V, an error of 7.5% occurs, and thus, an outflow current is larger than an inflow current.

Similarly, even in the common feedback circuit shown in FIG. 22, a similar error occurs. However, this error further can be reduced by a loop gain A1 determined by the n-channel MOS transistors M10, M11 constituting a differential amplifier (error amplifier), the current mirrors M8, M6*a*, M6*b*, and the loads 11 and 12. It should be noted that the loop gain A1 cannot be set to be large in order to prevent oscillation, and can be set to be at most 10 times. Thus, the error is reduced to 1/10, and 0.75% error remains. Furthermore, the loads 11 and 12 are placed in a loop of the common feedback circuit, so that they cannot take large values in order to prevent oscillation. Consequently, the gain of the differential amplifier composed of the n-channel MOS transistors M18 and M19 cannot be set to be large.

SUMMARY OF THE INVENTION

Therefore, with the foregoing in mind, it is an object of the present invention to provide a current source circuit capable of prescribing an outflow current to be equal to an inflow current.

Furthermore, it is another object of the present invention to provide an amplifier capable of setting a gain to be large while ensuring a stable operation point.

In order to achieve the above-mentioned object, a first current source circuit according to the present invention includes: a reference current source supplying a reference current; a first transistor group (M1, M2) connected in series to the reference current source, and converting the reference current into a voltage. A first transistor (M7) has a current mirror relationship with the first transistor group, and allows an output current to flow therethrough. An error amplifier (Op. Amp) receives a voltage generated in the first transistor group at one input terminal, and compares the voltage at the one input terminal with a voltage supplied to the other input terminal. A second transistor (M5) is driven with an output voltage of the error amplifier. A third transistor (M6) is driven with the output voltage of the error amplifier, and allows an output current to flow therethrough in a direction opposite to the output current of the first transistor with respect to an output terminal. A second transistor group (M3, M4) is connected in series to the second transistor, and converts a current flowing through the second transistor into a voltage to supply the voltage to the other input terminal of the error amplifier.

Furthermore, in order to achieve the above-mentioned object, a second current source circuit according to the present invention includes: a reference current source supplying a reference current and a first transistor (M2) connected in series to the reference current source, and converting the reference current into a voltage. A second transistor (M4) has a current mirror relationship with the first transistor, and converts a current into a voltage. A third transistor (M7) has a current mirror relationship with the first transistor, and allows an output current to flow therethrough. An error amplifier (Op. Amp) receives a voltage generated in the second transistor at one input terminal, and compares the voltage at the one input terminal with a voltage supplied to the other input terminal to output an error voltage. A voltage source supplies a voltage to the other input terminal of the error amplifier. A fourth transistor (M5) is connected in series to the second transistor, and is driven with an output voltage of the error amplifier. A fifth transistor M6) is driven with the output voltage of the error amplifier, and allows an output current to flow therethrough in a direction opposite to the output current of the third transistor with respect to an output terminal.

According to the above-mentioned first and second current source circuits, the outflow current of the output terminal can be set to be equal to the inflow current thereof.

Furthermore, in order to achieve the above-mentioned object, a first amplifier according to the present invention includes a reference current source supplying a reference current and a first transistor (M2) connected in series to the reference current source, and converting the reference current into a voltage. A second transistor (M4) has a current mirror relationship with the first transistor, and converts a current into a voltage. A third transistor (M7) has a current mirror relationship with the first transistor, and allows a first current to pass therethrough. An error amplifier (Op. Amp) receives a voltage generated in the second transistor at one input terminal, and compares the voltage at the one input terminal with a voltage supplied to the other input terminal to output an error voltage. A voltage source supplies a voltage to the other input terminal of the error amplifier. A fourth transistor (M5) is connected in series to the second transistor and is driven with an output voltage of the error amplifier. A fifth transistor (M6) is driven with the output voltage of the error amplifier and allows a second current to flow therethrough. A differential amplifier (Diff. Amp) is operated using the first current flowing through the third transistor as one supply current and using the second current flowing through the fifth transistor as the other supply current, and amplifies a voltage supplied to an input terminal.

In the first amplifier, the reference voltage at an operation point of the differential amplifier is set to be the voltage of the voltage source.

In order to achieve the above-mentioned object, a second amplifier according to the present invention includes a reference current source supplying a reference current and a first transistor (M2) connected in series to the reference current source, and converting the reference current into a voltage. A second transistor (M4) has a current mirror relationship with the first transistor, and allows a first current to pass therethrough. A third transistor (M7) has a current mirror relationship with the first transistor, and allows a second current to pass therethrough. A first differential amplifier (1st Diff. Amp) is operated using the first current flowing through the second transistor as one supply current, and receives a voltage supplied to an input terminal. An error amplifier (Op. Amp) receives an output voltage of the first differential amplifier at the one input terminal, and compares the voltage at the one input terminal with a voltage supplied to the other input terminal to output an error voltage. A voltage source supplies a voltage to the other input terminal of the error amplifier. A fourth transistor (M5) operates the first differential amplifier, using a third current driven to flow with an output voltage of the error amplifier as the other supply current. A fifth transistor (M6) is driven with the output voltage of the error amplifier, and allows a fourth current to pass therethrough. A second differential amplifier (2nd Diff. Amp) is operated using the second current flowing through the third transistor as one supply current and using the fourth current flowing through the fifth transistor as the other supply current, and amplifies a voltage supplied to the input terminal.

In the second amplifier, a reference voltage at an operation point of the second differential amplifier is set at a voltage of the voltage source.

According to the above-mentioned first and second amplifiers, a gain can be set to be large while a stable operation point is ensured.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of preferred embodiments with reference to the drawings.

Embodiment 1

Figure 1:
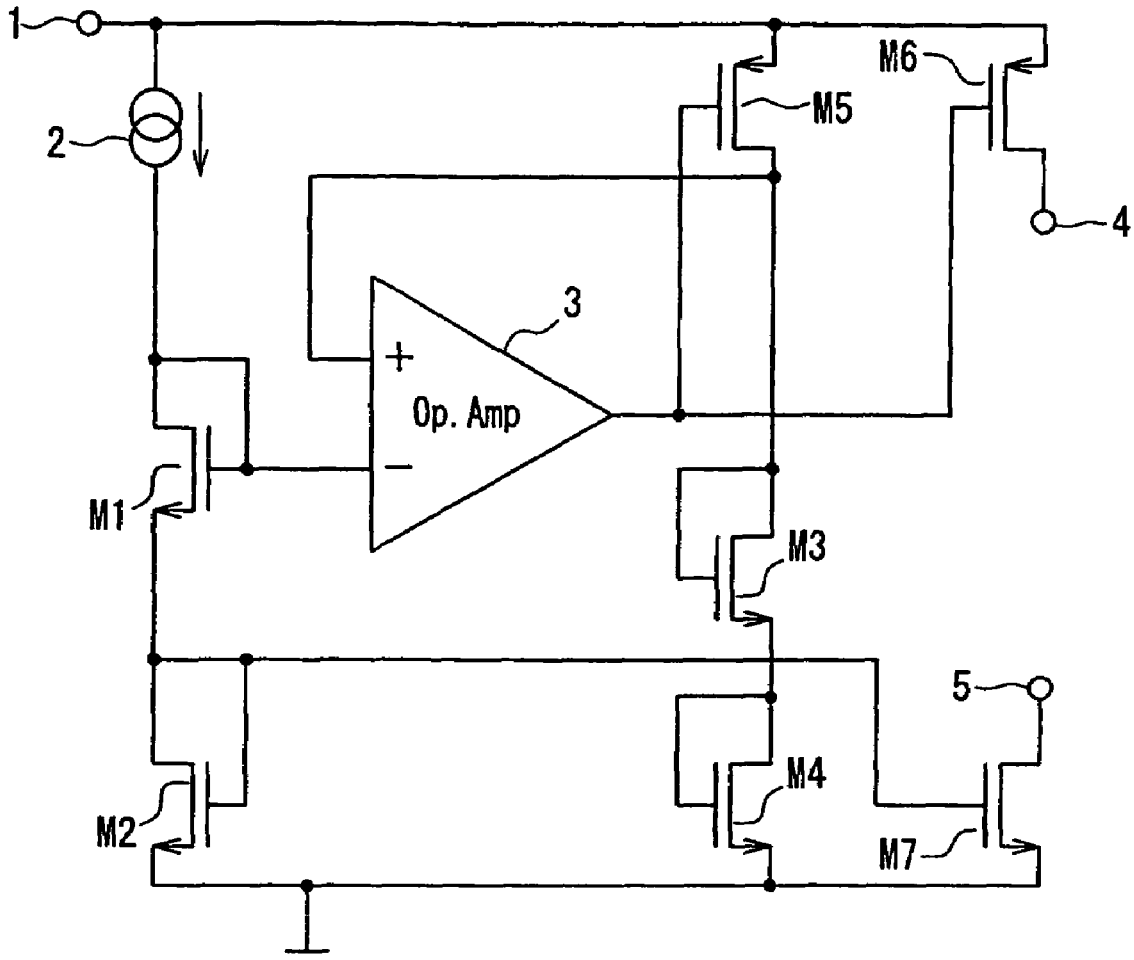
FIG. 1 is a circuit diagram showing an exemplary configuration of a current source circuit according to Embodiment 1 of the present invention.

FIG. 1 is a circuit diagram showing an exemplary configuration of a current source circuit according to Embodiment 1 of the present invention. In FIG. 1, reference numeral 3 denotes an error amplifier (Op. Amp) composed of an operational amplifier, M1, M2, M3, M4, M7 denote n-channel MOS transistors, and M5, M6 denote p-channel MOS transistors. The n-channel MOS transistors M1 and M2, which are included in a first transistor group, constitute a converter for converting a current of a reference current source 2 into a voltage. Furthermore, the n-channel MOS transistors (first transistors) M2 and M7 constitute a current mirror circuit. The p-channel MOS transistor (second transistor) M5 and the p-channel MOS transistor (third transistor) M6 constitute a current source driven with an output voltage of the error amplifier 3. Furthermore, the n-channel MOS transistors M3 and M4, which are included in a second transistor group, constitute a converter for converting a current of the p-channel MOS transistor into a voltage.

Figure 2:
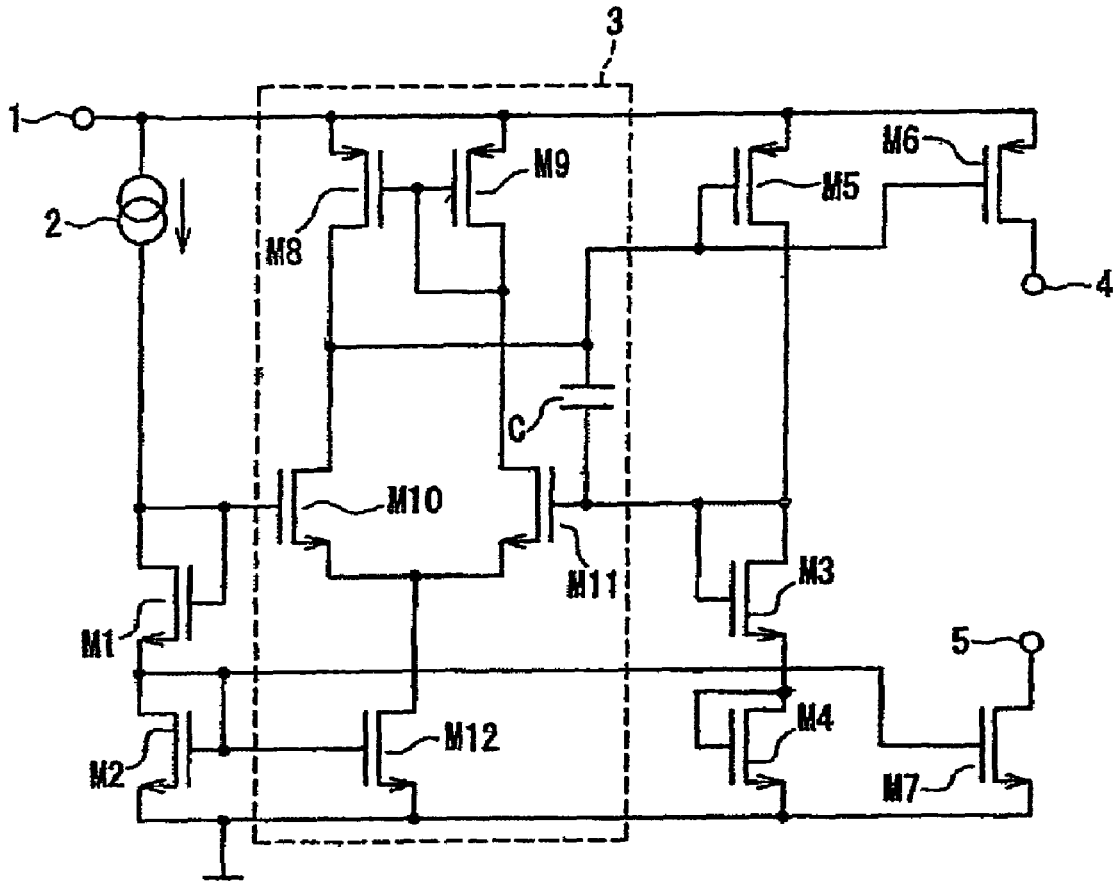
FIG. 2 is a circuit diagram showing a first specific example of the current source circuit shown in FIG. 1.

FIG. 2 is a circuit diagram showing a first specific example of the current source circuit shown in FIG. 1. In FIG. 2, M8, M9 denote p-channel MOS transistors, M10, M11, M12 denote n-channel MOS transistors, and C denotes a capacitor. The n-channel MOS transistor M12 functions as a current source, the n-channel MOS transistors M10 and M11 function as a differential transistor pair, and the p-channel MOS transistors M8 and M9 function as a current mirror that is an active load of the differential transistor pair M10 and M11. The transistors M8 to M12 and the capacitor C constitute the error amplifier 3.

Next, the operation of the current source circuit according to Embodiment 1 configured as above will be described.

A voltage generated in the first transistor group (M1, M2) and a voltage generated in the second transistor group (M3, M4) are input to the error amplifier 3, and a gate voltage of the p-channel MOS transistor M5 is adjusted so that these voltages are equal to each other. Thus, a current flowing from the p-channel MOS transistor M5 is equal to that of the reference current source 2, and a gate of the p-channel MOS transistor M6 is driven with the same voltage as the gate voltage of the p-channel MOS transistor M5. Therefore, a current of the p-channel MOS transistor M6 also is substantially equal to that of the reference current source 2. When a current ratio of an inflow current I5 of an output terminal 5 to an outflow current I4 of an output terminal 4 is calculated by adopting the same approximation as that in the conventional example, the following result is obtained:

$$I4/I5 = (1+\lambda\times Vds)/(1+\lambda\times Vds) = 1$$

As described above according to the present embodiment, by providing the first transistor group (M1, M2) for converting a current into a voltage, the second transistor group for converting a current into a voltage, the error amplifier for amplifying the difference of the respective converted voltages (error voltage), and the p-channel MOS transistors M5 and M6 driven by the error amplifier, an outflow current of the output terminal 4 can be set to be equal to an inflow current of the output terminal 5.

Figure 3:
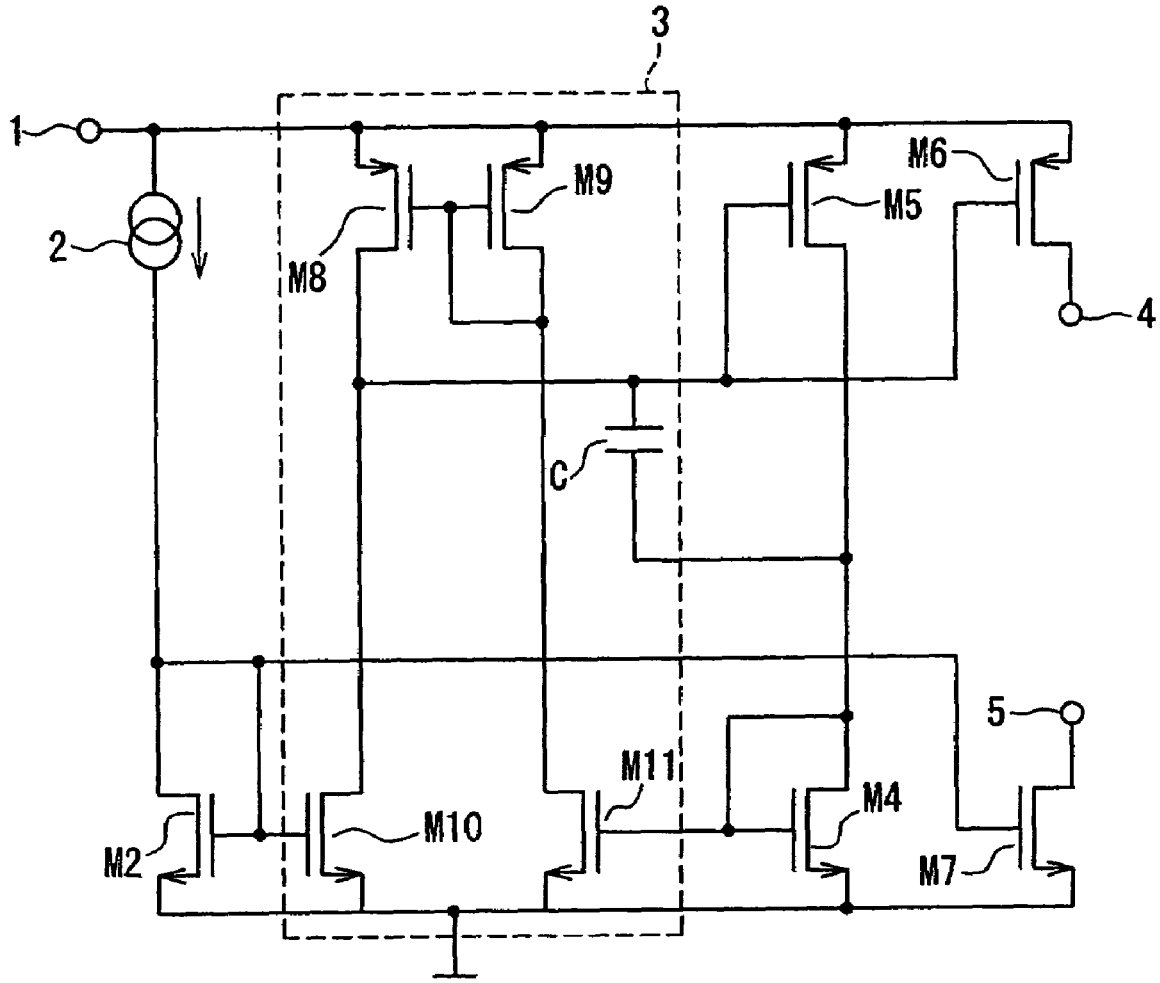
FIG. 3 is a circuit diagram showing a second specific example of the current source circuit shown in FIG. 1.

In the present embodiment, the transistors that are stacked in series in two stages are used as a converter. However, as shown in FIG. 3, the current source of the error amplifier 3 is omitted, and a one-stage transistor may be used as a converter.

Figure 4:
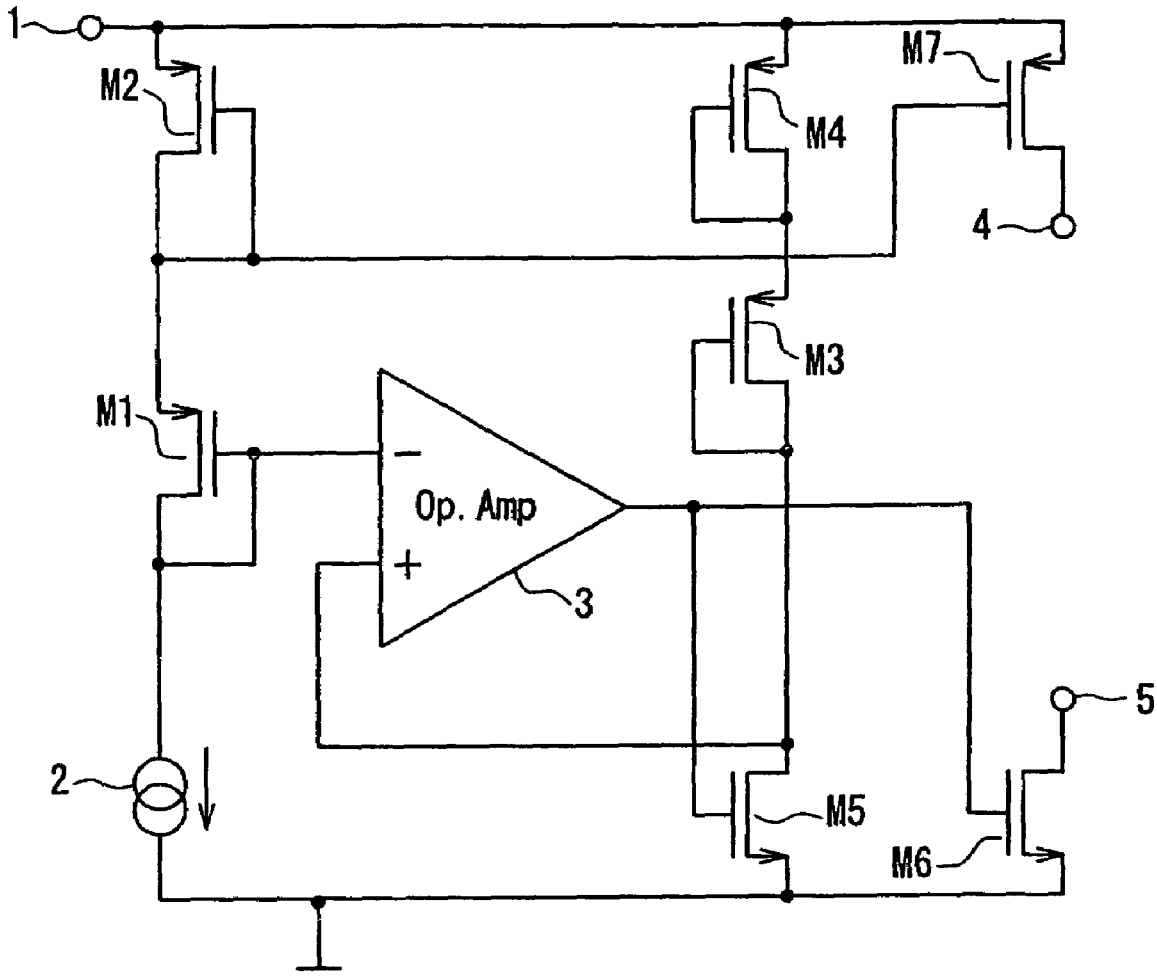
FIG. 4 is a circuit diagram showing a modified example of the current source circuit shown in FIG. 1.
Figure 5:
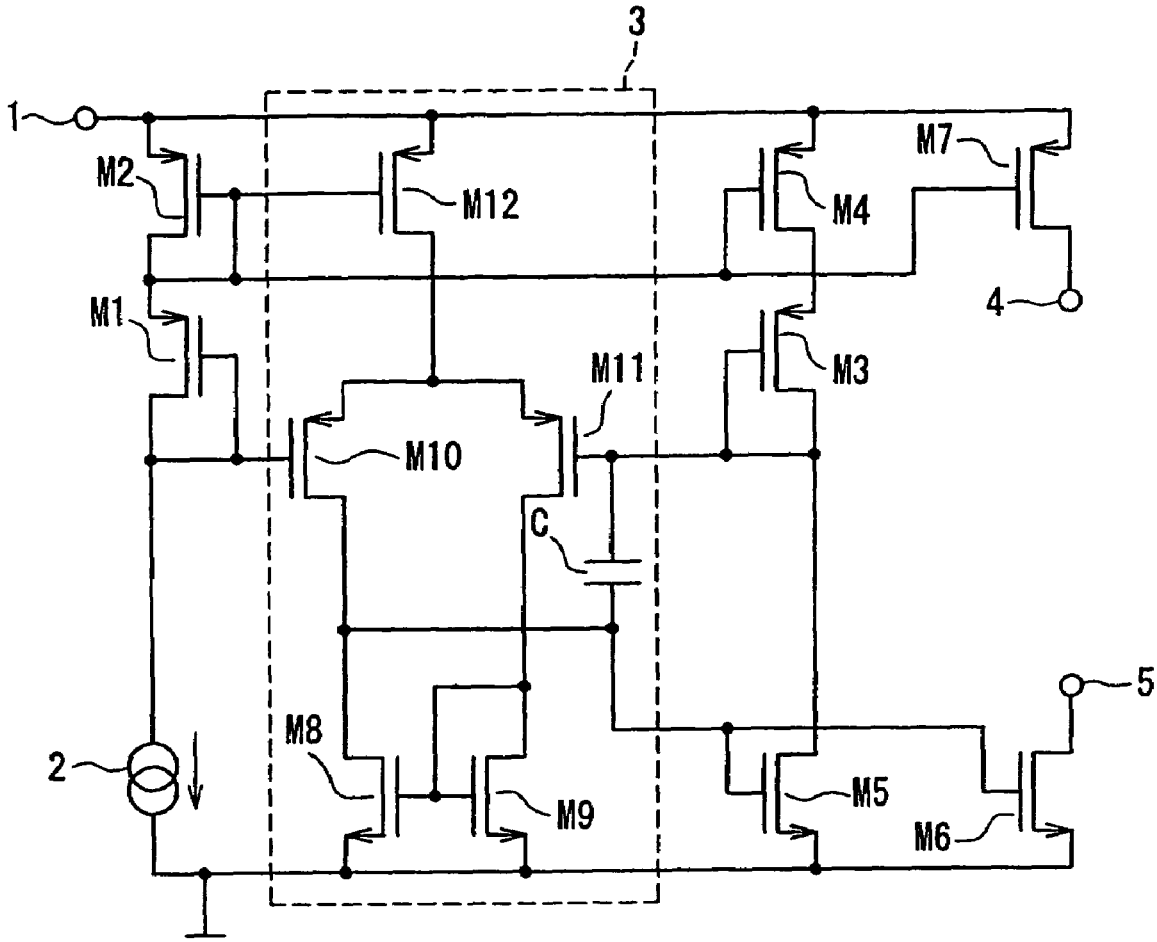
FIG. 5 is a circuit diagram showing a first specific example of the current source circuit shown in FIG. 4.
Figure 6:
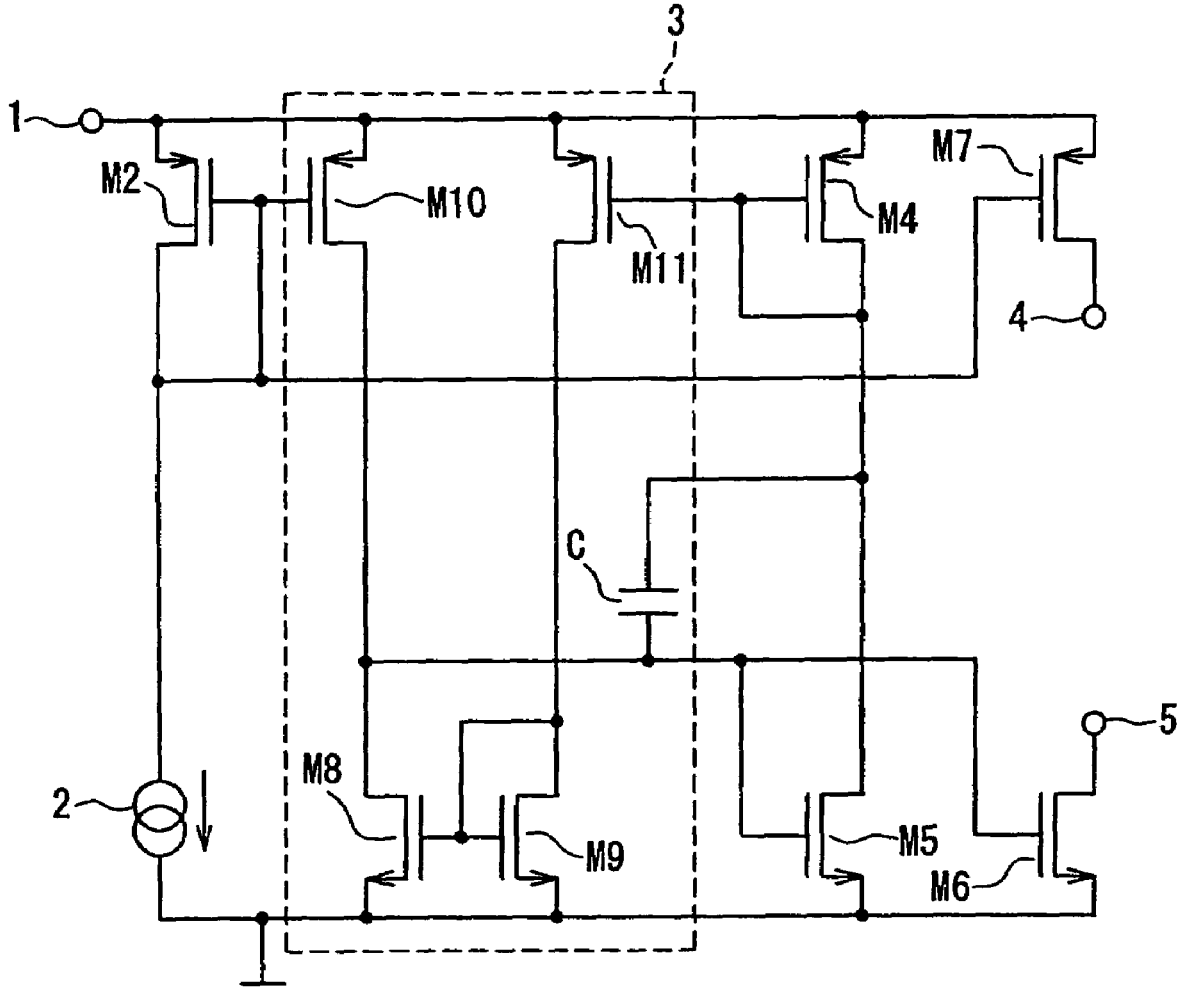
FIG. 6 is a circuit diagram showing a second specific example the current source circuit shown in FIG. 4.

Furthermore, in the present embodiment, the current source circuit is configured using the n-channel MOS transistors as a converter. However, as shown in FIGS. 4, 5, and 6, a current source circuit may be configured using the p-channel MOS transistors as a converter.

Furthermore, in the present embodiment, a current source circuit is configured using the MOS transistors. However, a current source circuit may be configured using bipolar transistors.

Embodiment 2

Figure 7:
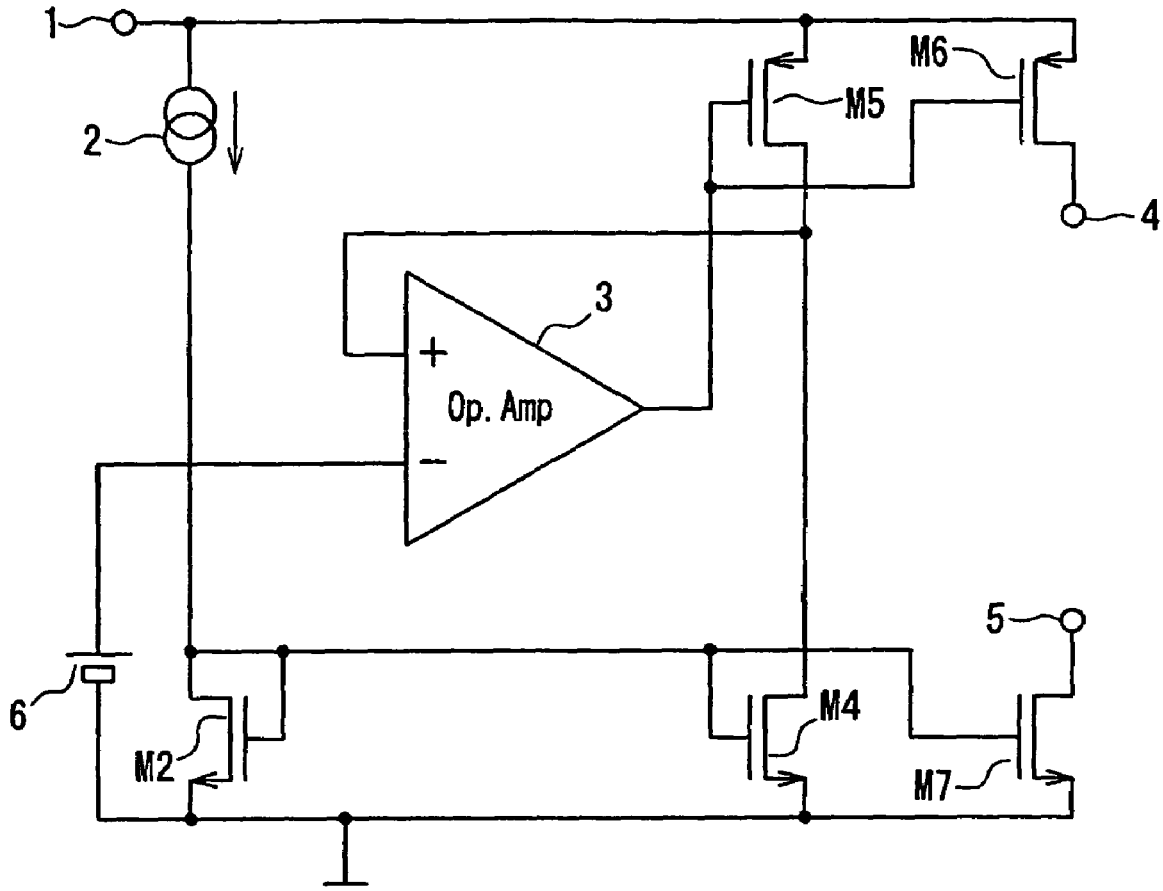
FIG. 7 is a circuit diagram showing an exemplary configuration of a current source circuit according to Embodiment 2 of the present invention.

FIG. 7 is a circuit diagram showing an exemplary configuration of a current source circuit according to Embodiment 2 of the present invention. In FIG. 7, the components having the same configurations and functions as those in Embodiment 1 are denoted with the same reference numerals as those therein, and their description will be omitted here. In FIG. 7, reference numeral 6 denotes a voltage source for determining an operation point of an amplifier.

Next, the operation of the current source circuit according to Embodiment 2 configured as above will be described.

In FIG. 7, gate voltages of the p-channel MOS transistors M5 and M6 are adjusted so that a voltage at a connection point between a drain of the transistor M4 and a drain of the transistor M5 is equal to a voltage of the voltage source 6. In this case, a current ratio of the inflow current I5 flowing through the output terminal 5 to the outflow current I4 flowing through the output terminal 4 is obtained as follows:

$$I4/I5 = (1+\lambda\times Vds)/(1+\lambda\times Vds)$$
$$= 1$$

As described above, according to the present embodiment, by providing the voltage source 6 for generating a reference voltage at an operation point, the error amplifier 3, and the p-channel MOS transistors M5 and M6 driven by the error amplifier 3, the outflow current of the output terminal 4 can be set to be equal to the inflow current of the output terminal 5.

Embodiment 3

Figure 8:
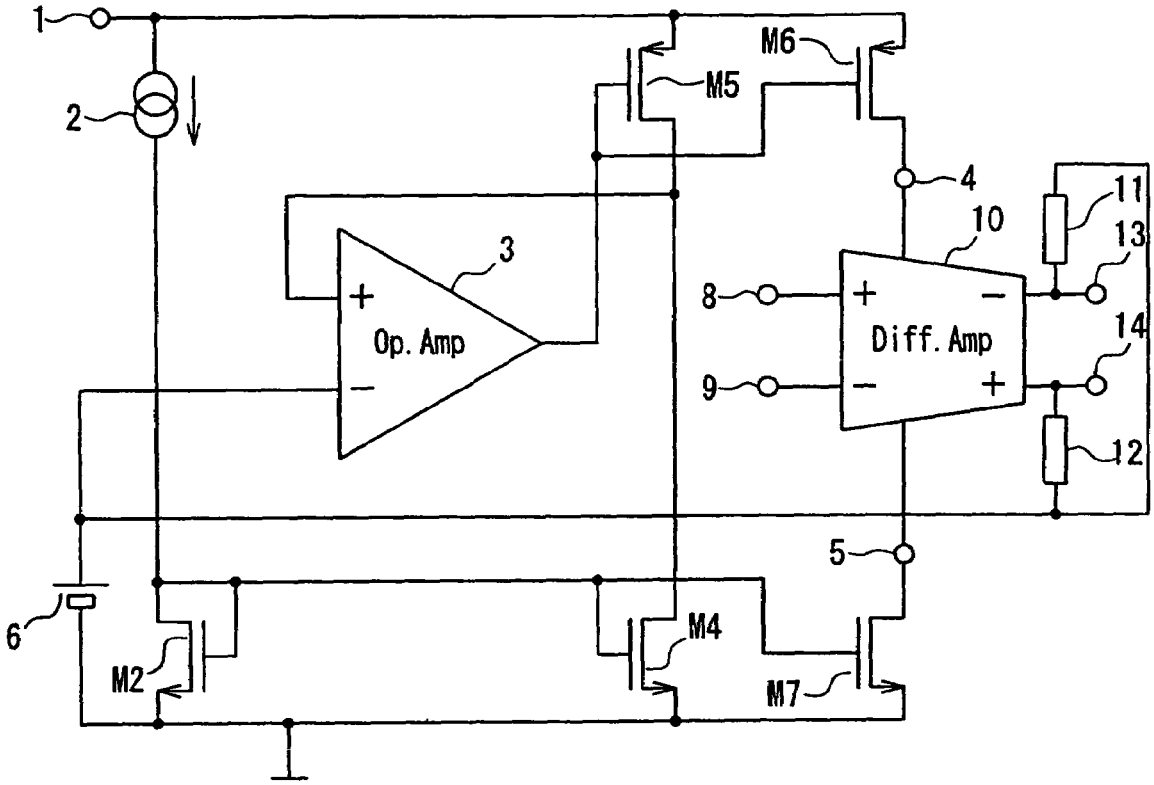
FIG. 8 is a circuit diagram showing an exemplary configuration of an amplifier according to a third embodiment of the present invention.

FIG. 8 is a circuit diagram showing an exemplary configuration of an amplifier according to Embodiment 3 of the present invention. The amplifier according to the present embodiment uses the current source circuit according to Embodiment 2.

In FIG. 8, reference numeral 10 denotes a differential amplifier (Diff. Amp) that includes input terminals 8, 9 and output terminal 13, 14. A load 11 is connected between the output terminal 13 and the voltage source 6, and a load 12 is connected between the output terminal 14 and the voltage source 6. The differential amplifier 10 is driven using a current flowing through the transistors M6 and M7 as a supply current.

Figure 9:
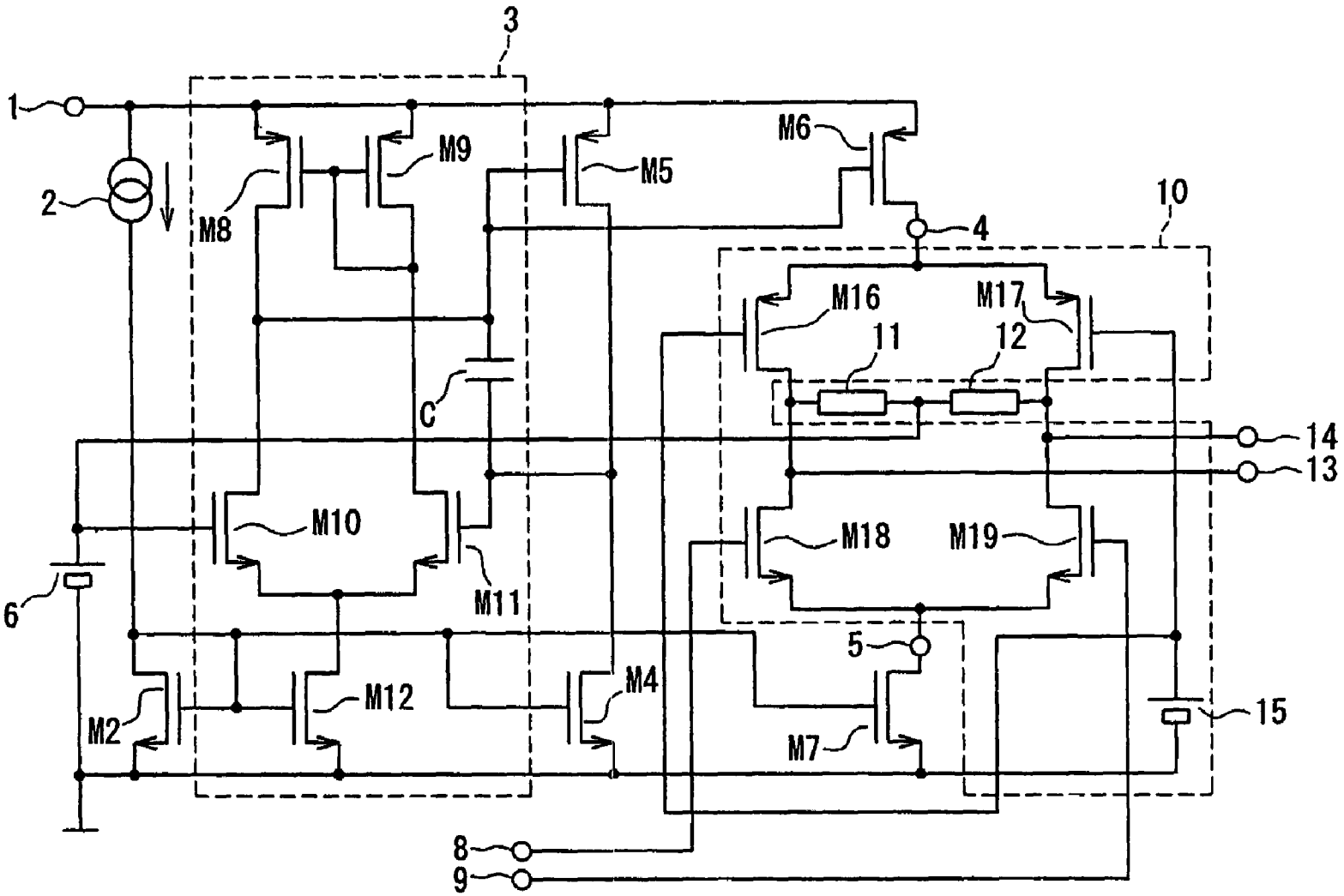
FIG. 9 is a circuit diagram showing a first specific example of an amplifier shown in FIG. 8.

FIG. 9 is a circuit diagram showing a first specific example of the amplifier according to the present embodiment. In FIG. 9 reference numeral 15 denotes a voltage source, M16, M17 denote p-channel MOS transistors, and M18, M19 denote n-channel MOS transistors. A current supplied from the p-channel MOS transistor M6 is divided by the voltage source 6 and the p-channel MOS transistors M16 and M17. Furthermore, currents from the n-channel MOS transistors M18 and M19 are supplied to the n-channel MOS transistor M7 through the p-channel MOS transistors M16 and M17, respectively.

Next, the operation of the amplifier according to Embodiment 3 configured as above will be described.

In FIG. 9, signals input to the differential transistor pair (M18 and M19) are amplified by the loads 11 and 12 to be output to the output terminals 13 and 14. At this time, as a necessary condition for the operation, the operation center of the output terminals 13 and 14 must be operated with the voltage of the voltage source 6. For this purpose, the following is required: the outflow current due to the p-channel MOS transistor M6 is equal to the inflow current due to the n-channel MOS transistor M7; the differential transistor pair (M18, M19) equally distributes the current due to the n-channel MOS transistor M7 at the operation center; and furthermore, the voltage source 15 and the p-channel MOS transistors M16 and M17 equally distribute a current due to the p-channel MOS transistor M6.

Consequently, the voltage at the operation center of the output terminals 13 and 14 is equal to the voltage at the connection point between the drain of the p-channel MOS transistor M5 and the drain of the n-channel MOS transistor M4. This voltage is equal to that of the voltage source 6 because of the error amplifier 3, and the voltage at the operation center of the output of the differential amplifier 10 also is equal to that of the voltage source 6.

At this time, the loads 11 and 12 are not included in the loop of the error amplifier 3. Therefore, the loads 11 and 12 of the differential amplifier 10 composed of the differential transistor pair (M18, M19) can have a large resistance. Because of this, the gain of the amplifier can be increased. Furthermore, the loads 11 and 12 can be omitted, and an amplifier with a large gain set at an output impedance of the MOS transistor also can be configured.

As described above, according to the present embodiment, by providing the current source circuit according to Embodiment 2 and the differential amplifier for amplifying a signal, a gain can be set to be large while a stable operation point is ensured.

Figure 10:
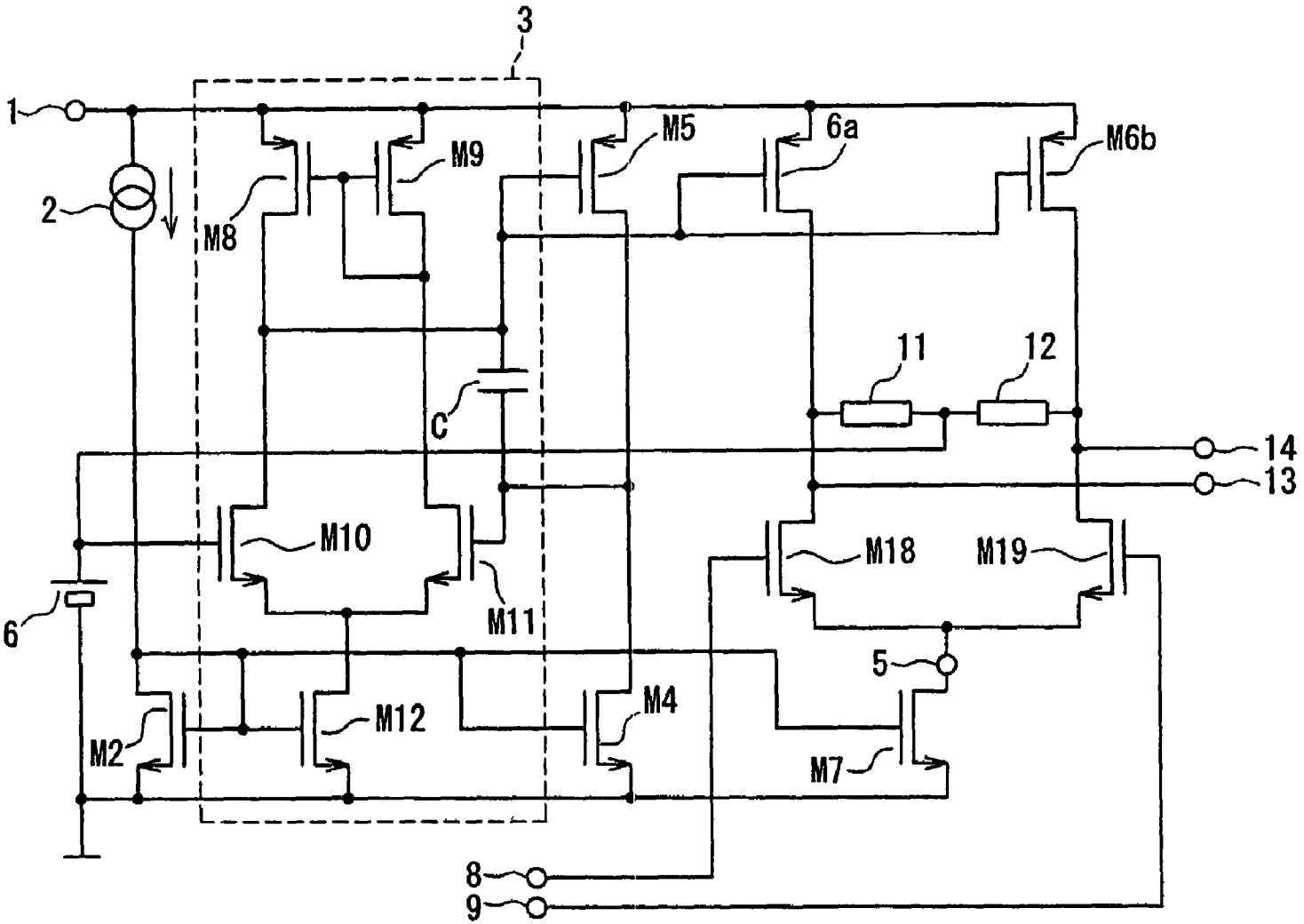
FIG. 10 is a circuit diagram showing a second specific example of the amplifier shown in FIG. 8.

In the present embodiment, the voltage source 6 and the p-channel MOS transistors M16 and M17 are used as a current distributor. However, as shown in FIG. 10, the p-channel MOS transistor M16 shown in FIG. 9 is divided into M6*a* and M6*b*, and the voltage source 15 and the p-channel MOS transistors M16 and M17 shown in FIG. 9 may be omitted.

Figure 11:
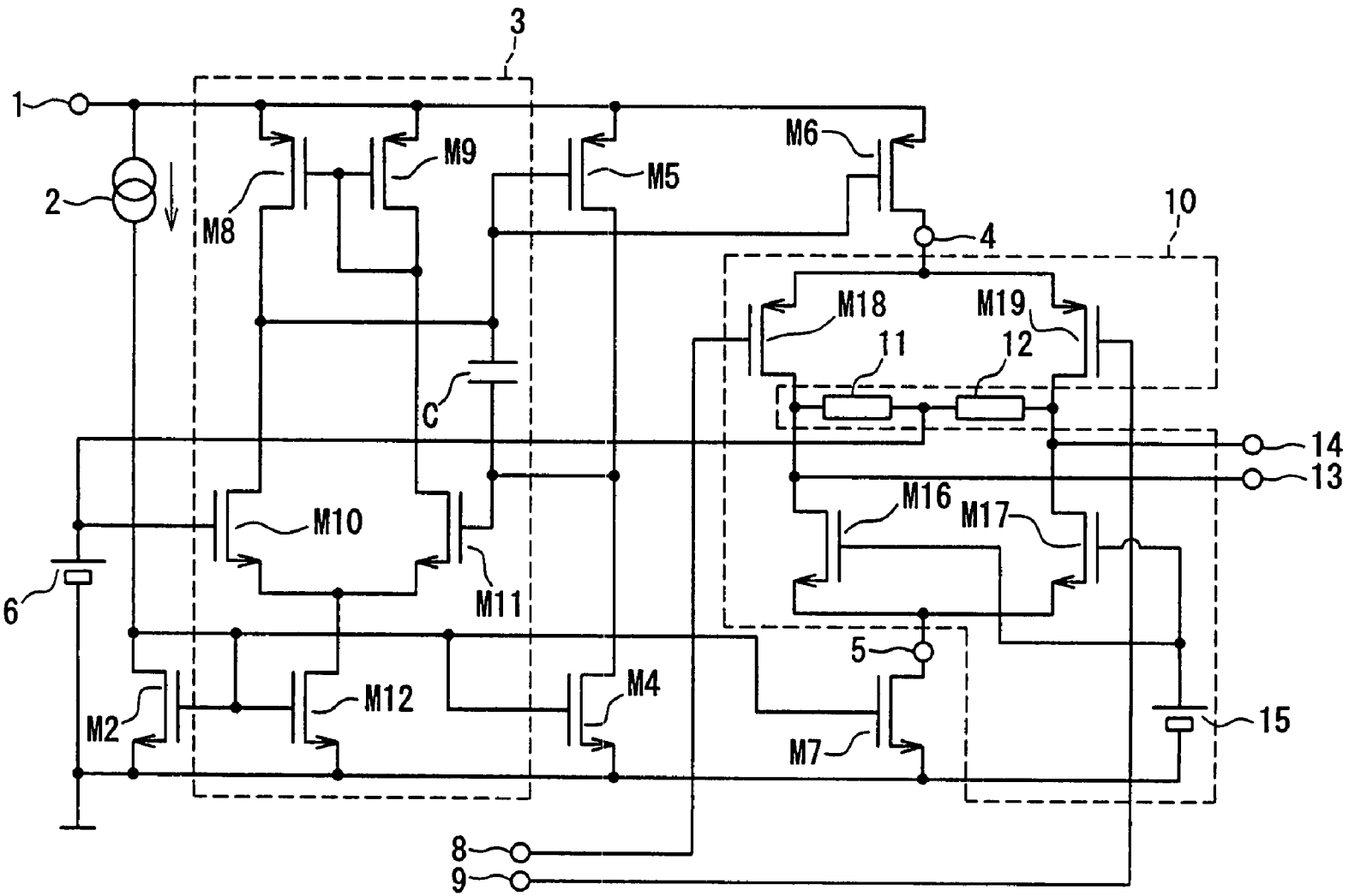
FIG. 11 is a circuit diagram showing a third specific example of the amplifier shown in FIG. 8.

Furthermore, in the present embodiment, a signal is input to the n-channel MOS transistor. However, as shown in FIG. 11, a signal may be input to the p-channel MOS transistor.

Figure 12:
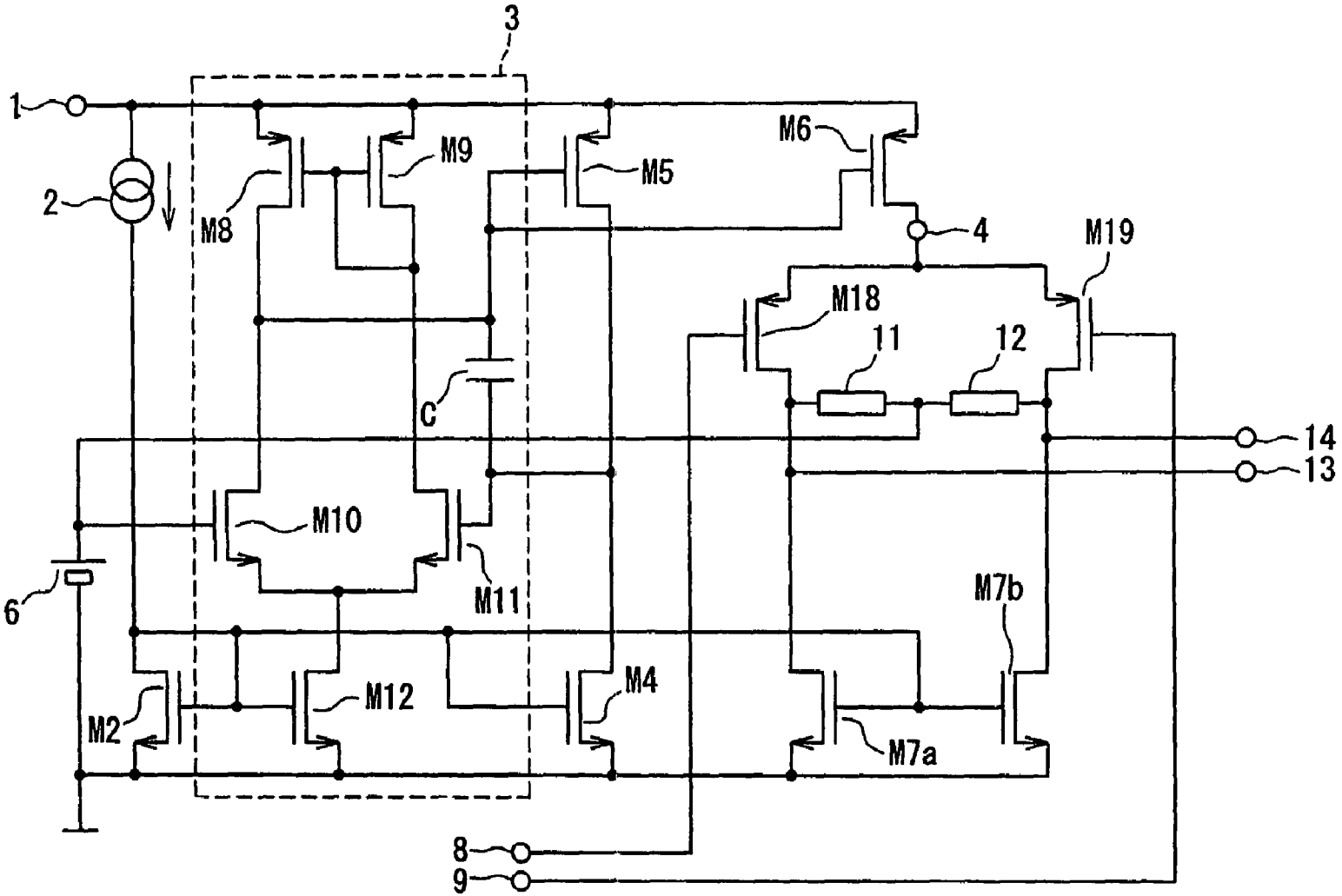
FIG. 12 is a circuit diagram showing a fourth specific example of the amplifier shown in FIG. 8.

Furthermore, in the present embodiment, the voltage source 6 and the p-channel MOS transistors M16 and M17 are used as a current distributor. However, as shown in FIG. 12, the n-channel MOS transistor M7 shown in FIG. 9 is divided into M7*a* and M7*b*, and the voltage source 15 and the p-channel MOS transistors M16 and M17 shown in FIG. 9 may be omitted.

Figure 13:
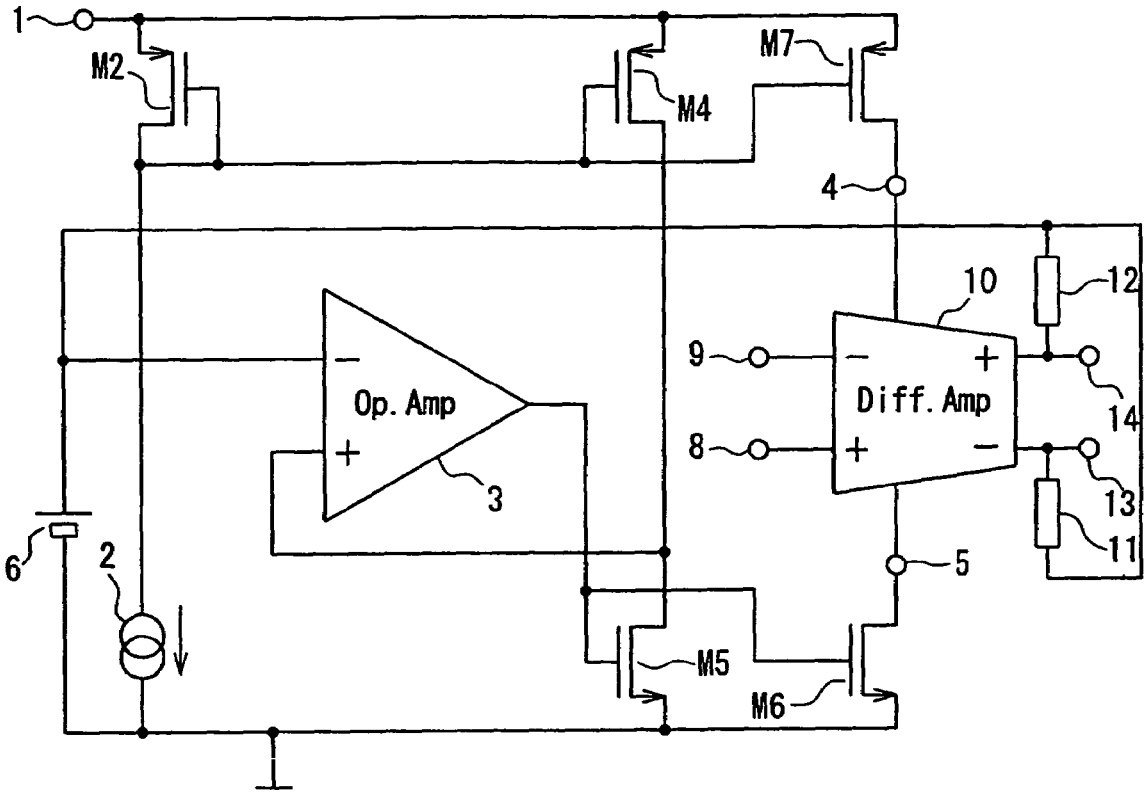
FIG. 13 is a circuit diagram showing a modified example of the amplifier shown in FIG. 8.

Furthermore, in the present embodiment, the amplifier is configured using the n-channel MOS transistors shown in FIG. 8 as a current mirror. However, as shown in FIG. 13, the amplifier may be configured using the p-channel MOS transistor as a current mirror.

Furthermore, in the present embodiment, the amplifier is configured using the MOS transistors. However, the amplifier may be configured using bipolar transistors.

Embodiment 4

Figure 14:
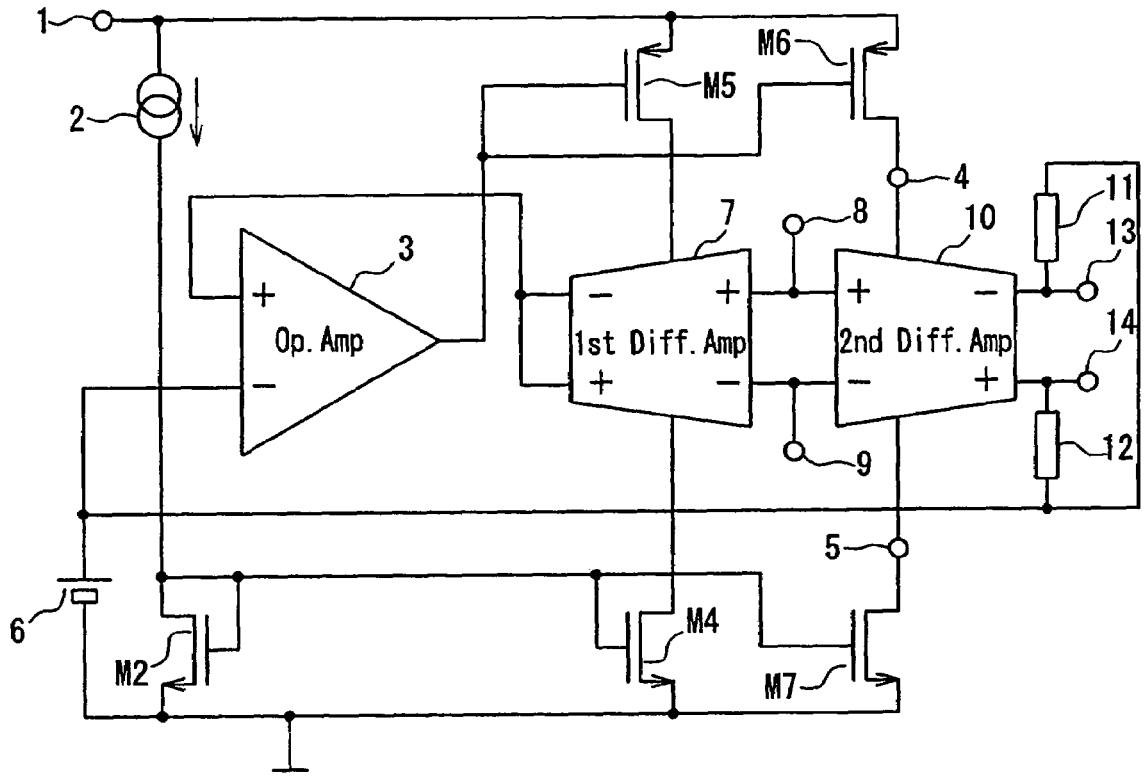
FIG. 14 is a circuit diagram showing an exemplary configuration of an amplifier according to Embodiment 4 of the present invention.

FIG. 14 is a circuit diagram showing an exemplary configuration of an amplifier according to Embodiment 4 of the present invention. In FIG. 14, reference numeral 7 denotes a first differential amplifier (1st Diff. Amp), and 10 denotes a second differential amplifier (2nd Diff. Amp) having a configuration equivalent to the first differential amplifier 7. The other configuration is the same as that of Embodiment 3 shown in FIG. 8.

Figure 15:
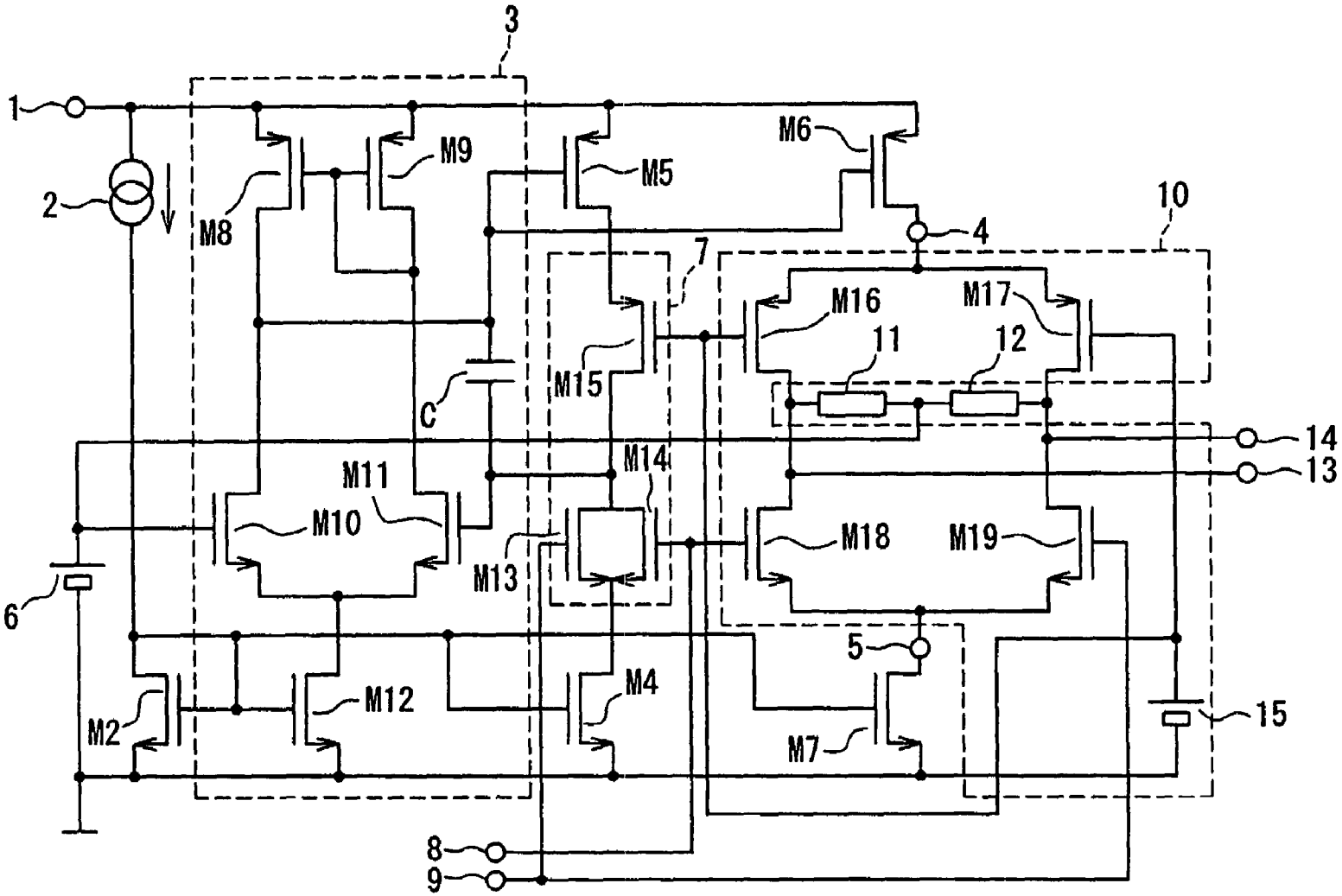
FIG. 15 is a circuit diagram showing a first specific example of the amplifier shown in FIG. 14.

FIG. 15 is a circuit diagram showing a specific example of the amplifier shown in FIG. 14. In FIG. 15, n-channel MOS transistors M13 and M14 constitute a differential transistor pair, a p-channel MOS transistor M15 constitutes a gate ground circuit, and the transistors M13, M14, and M15 constitute a first differential amplifier 7 equivalent to the second differential amplifier 10.

Next, the operation of the amplifier according to Embodiment 4 configured as above will be described.

In Embodiment 3, the channel modulation effect λ and Vds of the MOS transistor are approximated to be substantially constant. However, by providing the equivalent first differential amplifier 7, the operation state of the MOS transistor of the first differential amplifier 7 becomes equal to the operation state of the MOS transistor of the second differential amplifier 10, and an error ascribed to the current ratio of the inflow current of the output terminal 5 to the outflow current of the output terminal 4 is reduced further.

As described above, according to the present embodiment, by providing the differential amplifier 7 equivalent to the differential amplifier 10 in Embodiment 3, a gain is set to be large while ensuring a stable operation point, and an error can be reduced further.

Figure 16:
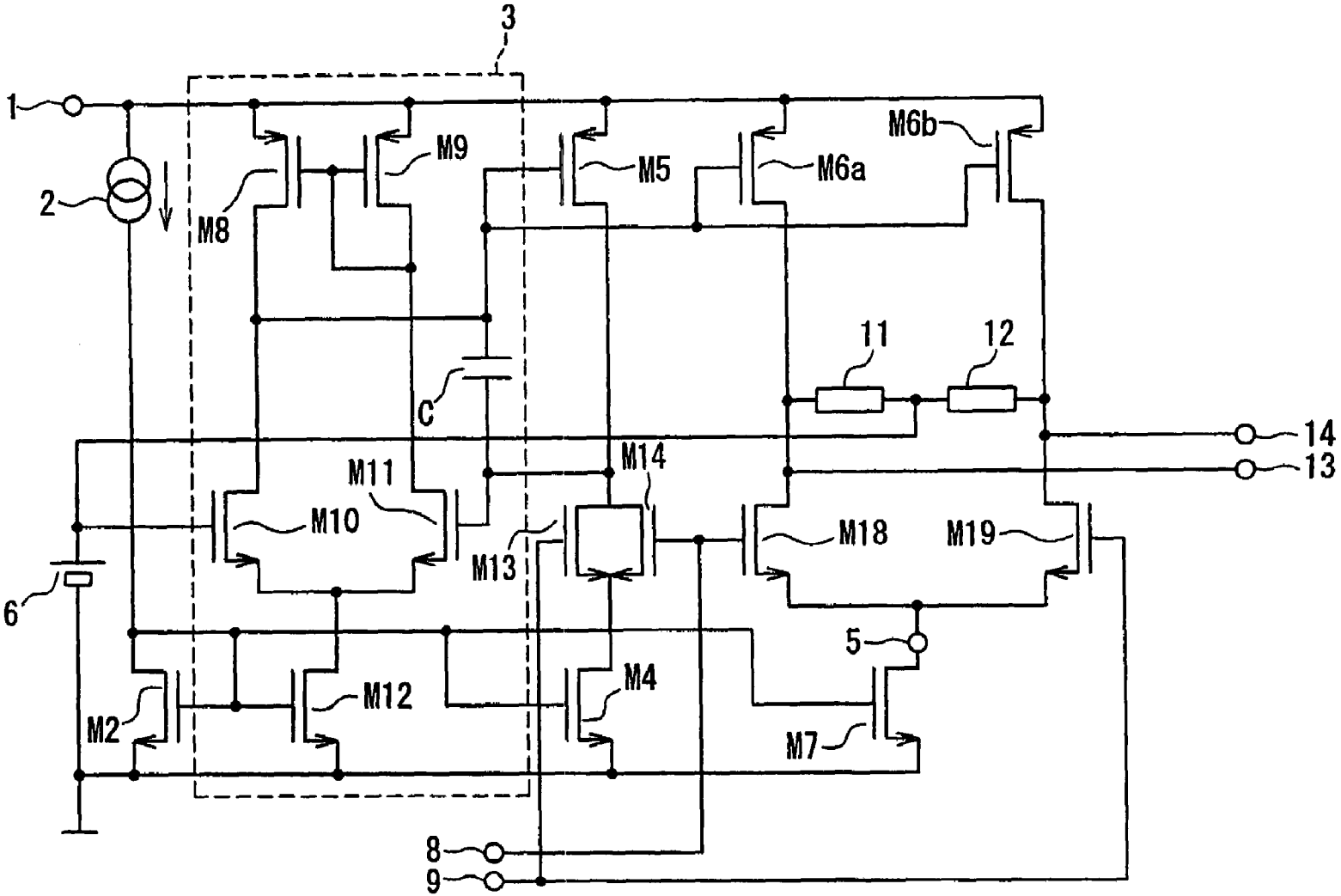
FIG. 16 is a circuit diagram showing a second specific example of the amplifier shown in FIG. 14.

In the present embodiment, the voltage source 6 and the transistors M15, M16, and M17 shown in FIG. 15 are used as a current distributor. However, as shown in FIG. 16, the transistor M6 shown in FIG. 15 is divided into M6*a* and M6*b*, and the voltage source 15 and the transistors M15, M16, and M17 shown in FIG. 15 may be omitted.

Figure 17:
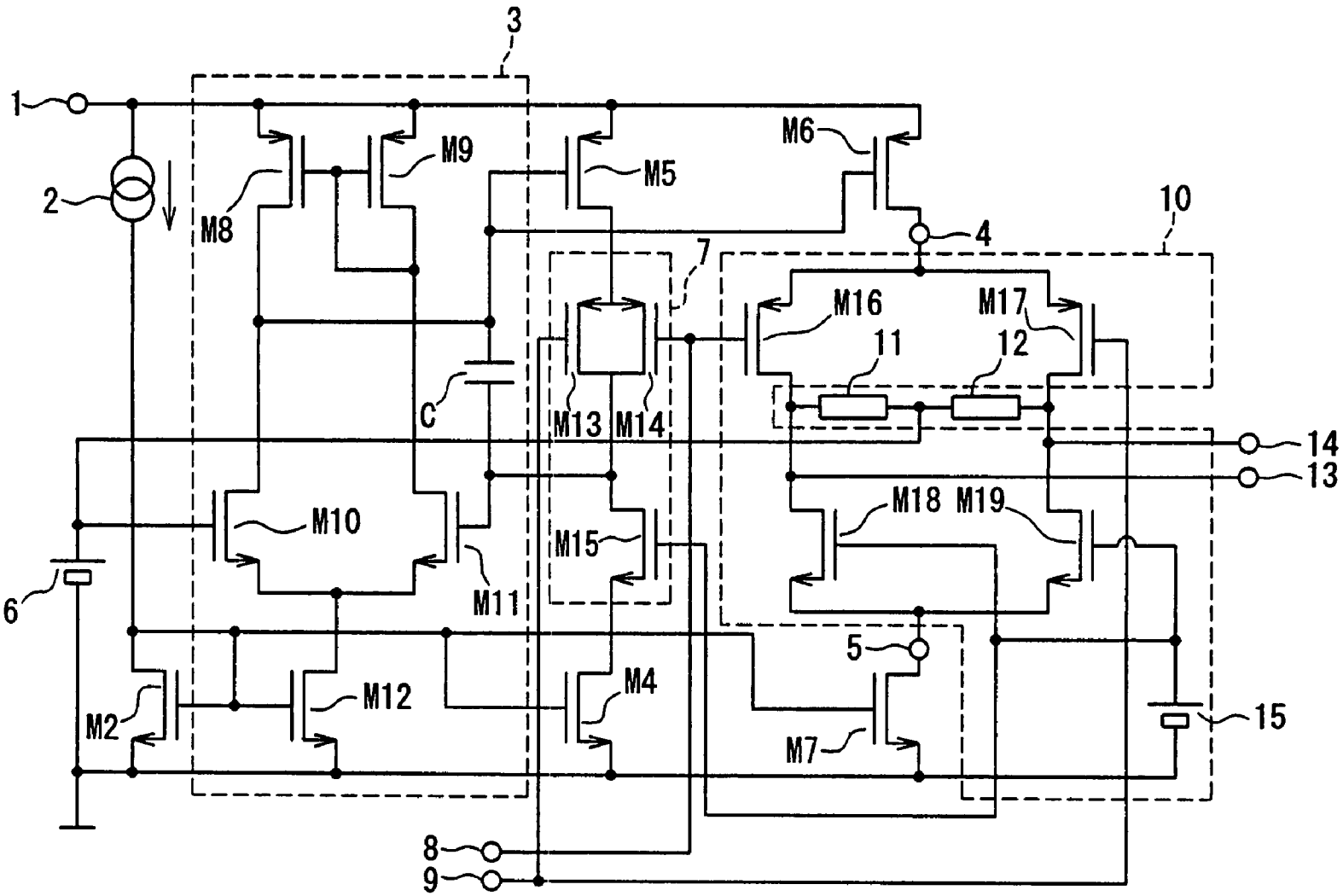
FIG. 17 is a circuit diagram showing a third specific example of the amplifier shown in FIG. 14.

Furthermore, in the present embodiment, a signal is input to the n-channel MOS transistor. However, as shown in FIG. 17, a signal may be input to a p-channel MOS transistor.

Figure 18:
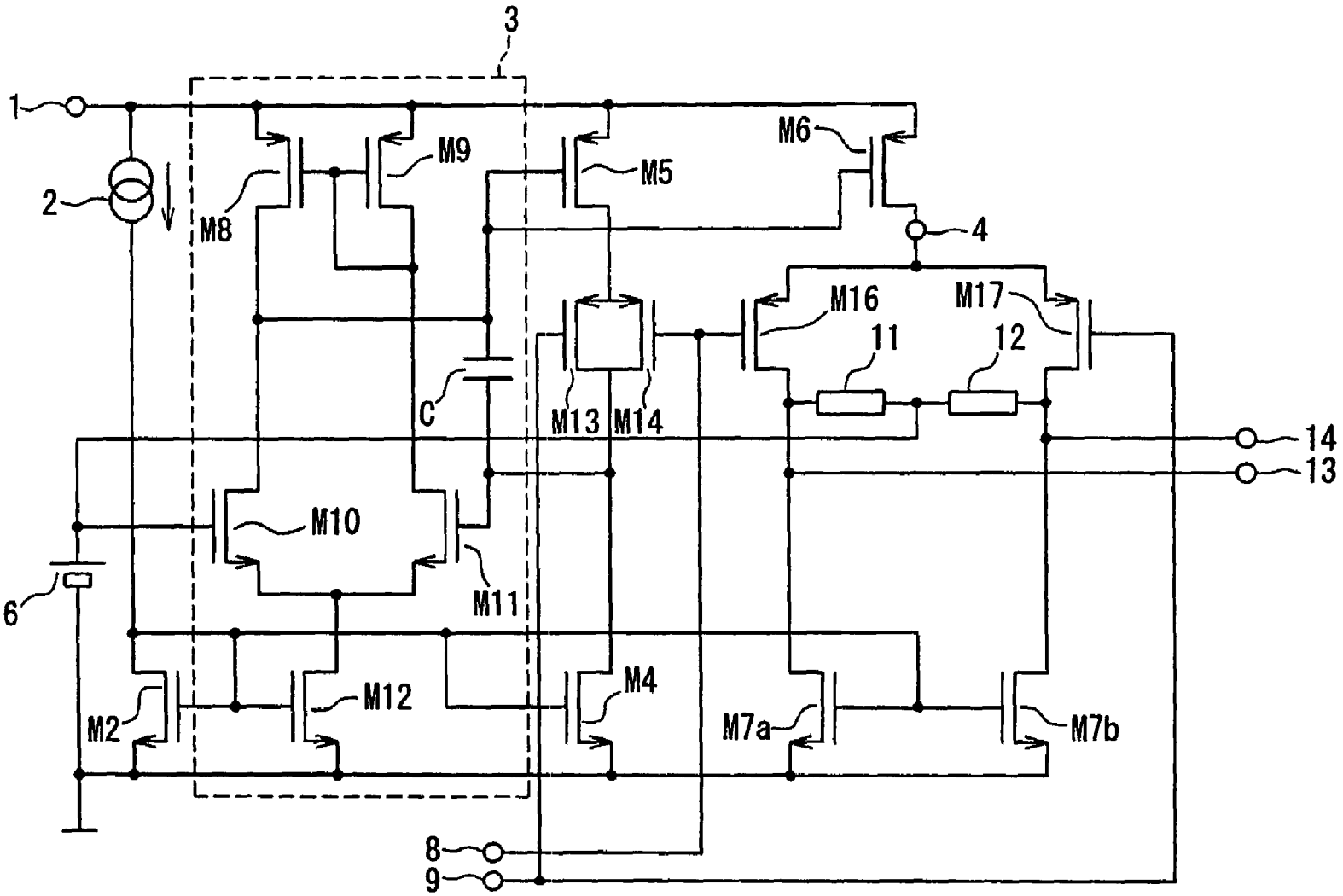
FIG. 18 is a circuit diagram showing a fourth specific example of the amplifier shown in FIG. 14.

Furthermore, in the present embodiment, the voltage source 6 and the transistors M15, M16, and M17 shown in FIG. 15 are used as a current distributor. However, as shown in FIG. 18, the transistor M7 shown in FIG. 15 is divided into M7*a* and M7*b*, and the voltage source 15 and the transistors M15, M16, and M17 shown in FIG. 15 may be omitted.

Figure 19:
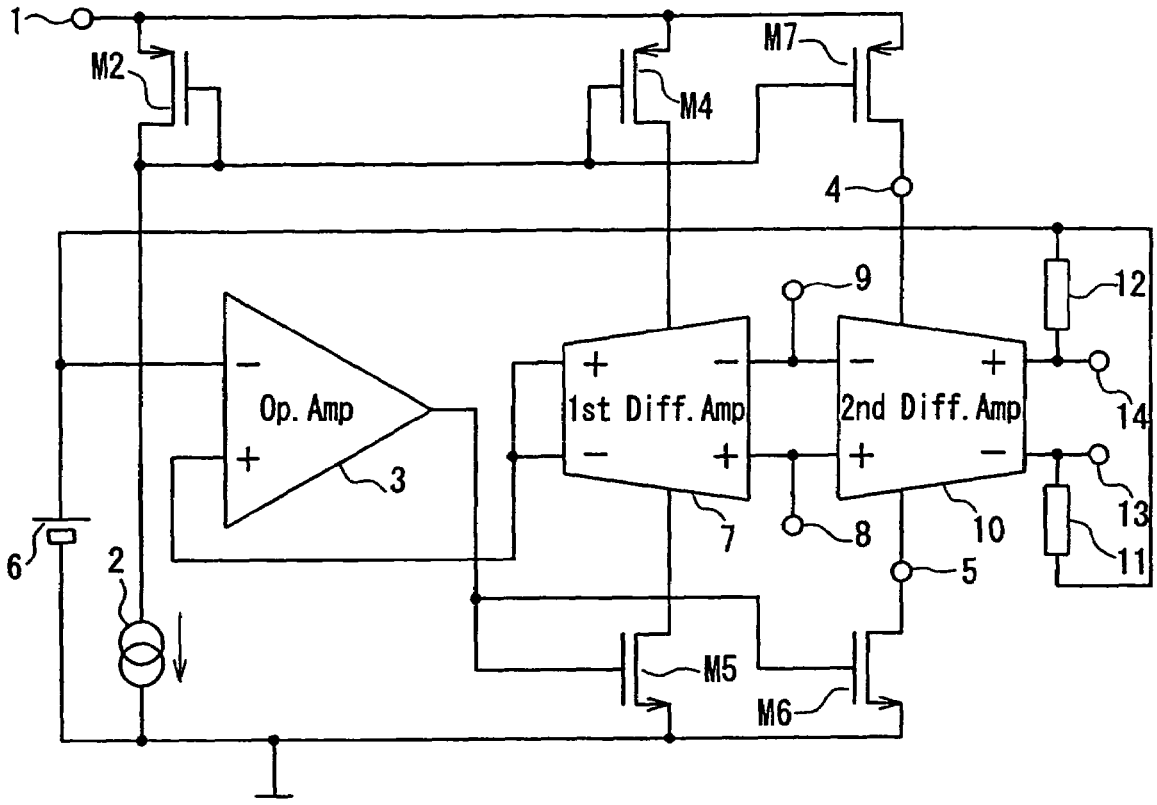
FIG. 19 is a circuit diagram showing a modified example of the amplifier shown in FIG. 14.
Figure 20:
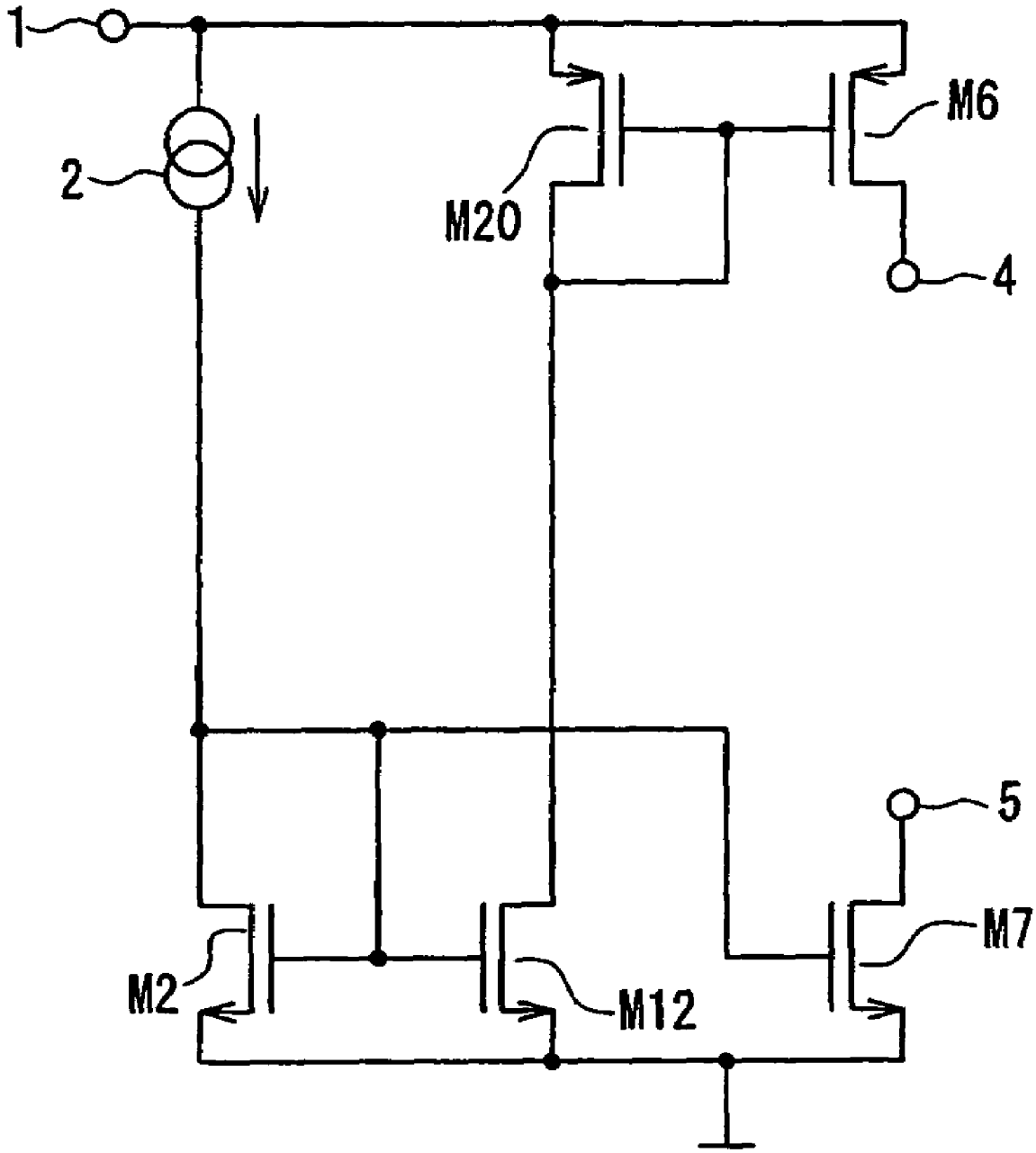
FIG. 20 PRIOR ART
FIG. 20 is a circuit diagram showing an exemplary configuration of a conventional current source circuit.
Figure 21:
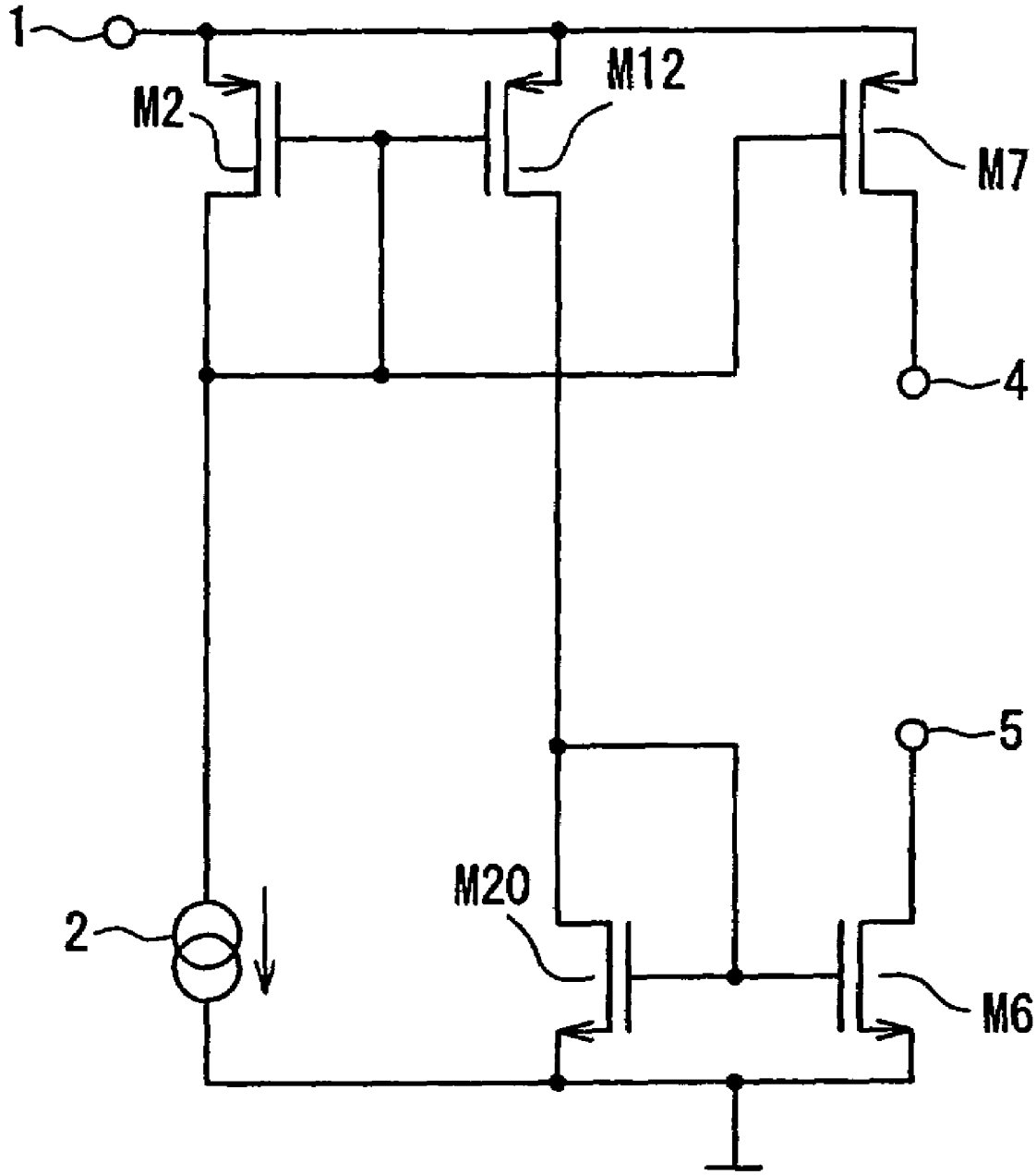
FIG. 21 PRIOR ART
FIG. 21 is a circuit diagram showing a modified example of a conventional current source circuit.
Figure 22:
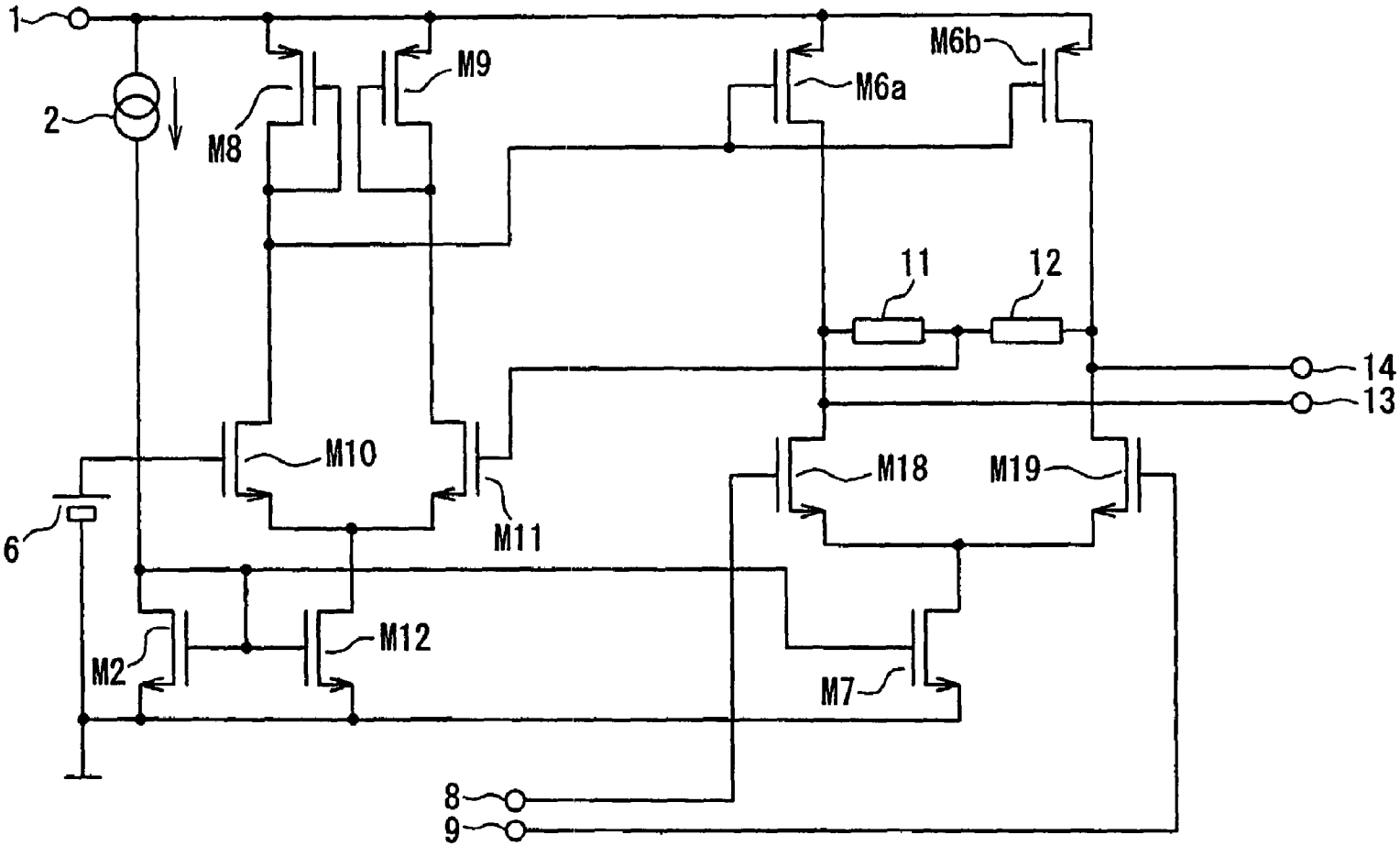
FIG. 22 PRIOR ART
FIG. 22 is a circuit diagram showing an exemplary configuration of a conventional amplifier.

Furthermore, in the present embodiment, the amplifier is configured using the n-channel MOS transistors as a current mirror. However, as shown in FIG. 19, the amplifier may be configured using the p-channel MOS transistors as a current mirror as shown in FIG. 19.

Furthermore, in the present embodiment, the amplifier is configured using the MOS transistors. However, the amplifier may be configured using bipolar transistors.

As described above, according to the present invention, an excellent current source circuit can be realized, which is capable of prescribing an inflow current to be equal to an outflow current of the output terminal.

Furthermore, an excellent amplifier can be realized, which is capable of setting a gain to be large while ensuring a stable operation point.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A current source circuit, comprising:

a reference current source supplying a reference current;

a first transistor group connected in series to the reference current source, and convening the reference current into a voltage;

a first transistor having a current mirror relationship with the first transistor group, and allowing an output current to flow therethrough;

an error amplifier receiving a voltage generated in the first transistor group at one input terminal, and comparing the voltage at the one input terminal with a voltage supplied to the other input terminal;

a second transistor driven with an output voltage of the error amplifier;

a third transistor driven with the output voltage of the error amplifier, and allowing an output current to flow therethrough in a direction opposite to the output current of the first transistor, such that an outflow current flowing out a first output terminal can be set equal to an inflow current flowing into a second output terminal; and a second transistor group connected in series to the second transistor, and converting a current flowing through the second transistor into a voltage to supply the voltage to the other input terminal of the error amplifier, the second transistor group being independent from the first transistor group.

* * * * *